US008523608B2

(12) United States Patent
Fu

(10) Patent No.: US 8,523,608 B2
(45) Date of Patent: Sep. 3, 2013

(54) ELECTRICAL CONNECTOR ASSEMBLY

(75) Inventor: Li-Ren Fu, Shenzhen (CN)

(73) Assignees: Hong Fu Precision Industry (ShenZhen) Co., Ltd., Shenzhen (CN); Hon Hai Precision Industry Co., Ltd., New Taipei (TW)

( * ) Notice: Subject to any disclaimer, the term of this patent is extended or adjusted under 35 U.S.C. 154(b) by 5 days.

(21) Appl. No.: 13/323,827

(22) Filed: Dec. 13, 2011

(65) Prior Publication Data

US 2013/0149895 A1 Jun. 13, 2013

(30) Foreign Application Priority Data

Dec. 8, 2011 (CN) ..... 2011 1 0405768

(51) Int. Cl.
*H01R 13/73* (2006.01)

(52) U.S. Cl.
USPC ..... 439/545; 439/247

(58) Field of Classification Search
USPC ..... 439/247, 544, 545, 549, 553–559
See application file for complete search history.

(56) References Cited

U.S. PATENT DOCUMENTS

| | | | | |
|---|---|---|---|---|
| 5,127,852 | A * | 7/1992 | Cravens et al. | 439/545 |
| 6,960,099 | B2 * | 11/2005 | McAlonis | 439/545 |
| 2013/0052862 | A1 * | 2/2013 | Fu et al. | 439/573 |
| 2013/0065432 | A1 * | 3/2013 | Fu et al. | 439/569 |
| 2013/0149895 | A1 * | 6/2013 | Fu | 439/545 |

* cited by examiner

*Primary Examiner* — James Harvey
(74) *Attorney, Agent, or Firm* — Altis Law Group, Inc.

(57) ABSTRACT

A connector assembly includes a connector and a fixing plate. The connector includes a block, a connector body formed on a front side of the block, two protrusions at the top and two at the bottom of the block, a limiting member acting as a backplate, and a protruding and deformable latch extending from the block. The fixing plate defines an opening, two notches communicating with the opening, and a positioning hole. When the connector body is pushed through the opening with the two protrusions respectively aligning with and passing through the two notches, the latch is deformed to abut against a rear surface of the fixing plate. The connector may be slid along the opening, to allow the latch to engage in the positioning hole. The protrusions are caught and locked in place by a front surface of the fixing plate.

6 Claims, 3 Drawing Sheets

ELECTRICAL CONNECTOR ASSEMBLY

BACKGROUND

1. Technical Field

The present disclosure relates to a connector.

2. Description of Related Art

In an electronic device, some connectors, such as serial advanced technology attachment (SATA) connectors, are mounted to a sidewall of an enclosure of the electronic device with screws. However, the screws are small and difficult to handle, and the installation of the connector in the computer is tedious.

BRIEF DESCRIPTION OF THE DRAWINGS

Many aspects of the present embodiments can be better understood with reference to the following drawings. The components in the drawings are not necessarily drawn to scale, the emphasis instead being placed upon clearly illustrating the principles of the present embodiments. Moreover, in the drawing, all the views are schematic, and like reference numerals designate corresponding parts throughout the several views.

DETAILED DESCRIPTION

The disclosure, including the accompanying drawings, is illustrated by way of example and not by way of limitation. It should be noted that references to "an" or "one" embodiment in this disclosure are not necessarily to the same embodiment, and such references mean at least one.

Figure 1:
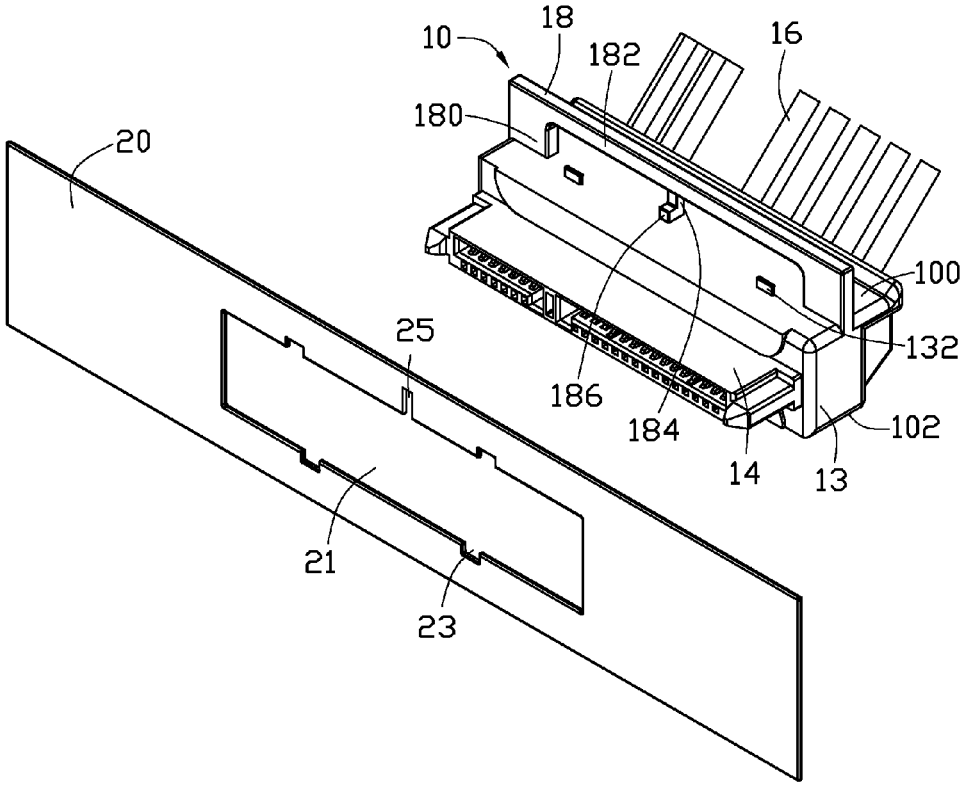
FIG. 1 is an exploded, isometric view of an exemplary embodiment of a connector assembly.

Referring to FIG. 1, an exemplary embodiment of a connector assembly includes a connector 10 and a fixing plate 20 for fixing the connector 10.

The connector 10 includes a block 13, a connector body 14 formed on a front surface of the block 13, a plurality of cables 16 connected to the connector body 14 and extending from a rear surface of the block 13, and a limiting member 18 extending from the top of the block 13. Two spaced protrusions 132 extend out from the top 100 of the block 13, and a similar two spaced protrusions (not shown) extend out from the bottom 102 of the block 13. The limiting member 18 includes two posts 180 extending up from the top 100 of the block 13, a connection piece 182 connected between tops of the posts 180, and an L-shaped latch 184 perpendicularly extending out from a center of the connection piece 182. The latch 184 includes a pin 186 extending out from a distal end of the latch 184 opposite to the connection piece 182. In this embodiment, the block 13 and the limiting member 18 are made of plastic.

The fixing plate 20 is a part of a sidewall of an electronic device enclosure. A substantially rectangular opening 21 is defined in the fixing plate 20. Two notches 23 and a positioning hole 25 are defined in the fixing plate 20 communicating with the top side of the opening 21, and two notches 23 only are defined in the fixing plate 20 communicating with the bottom side of the opening 21.

Figure 2:
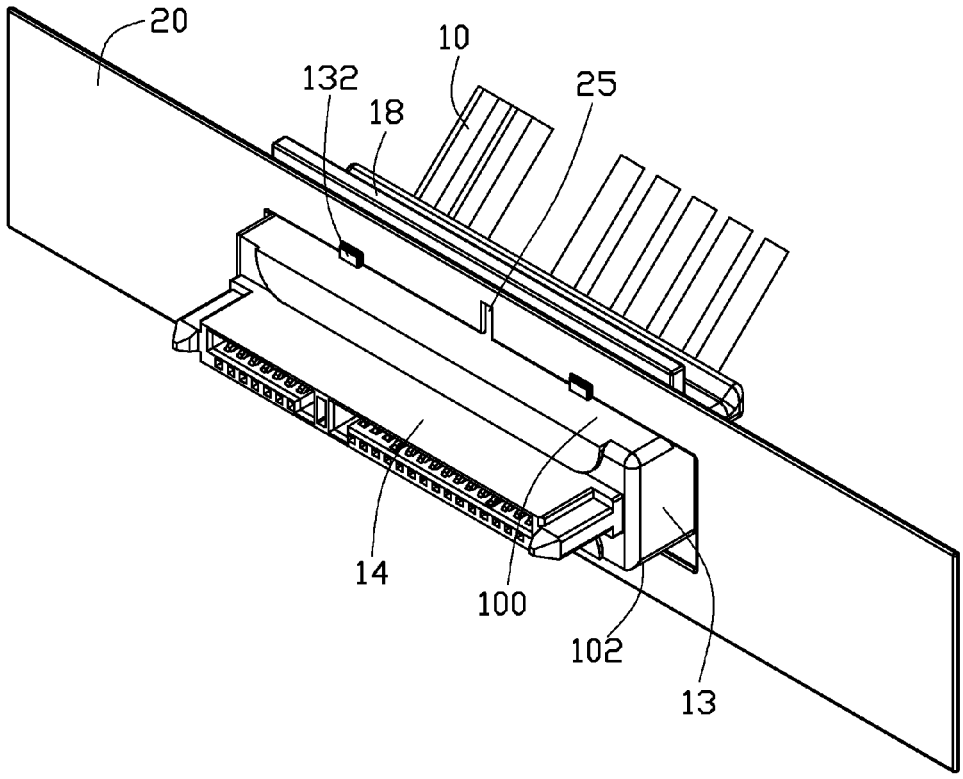
FIG. 2 is an assembled, isometric view of the connector assembly of FIG. 1.
Figure 3:
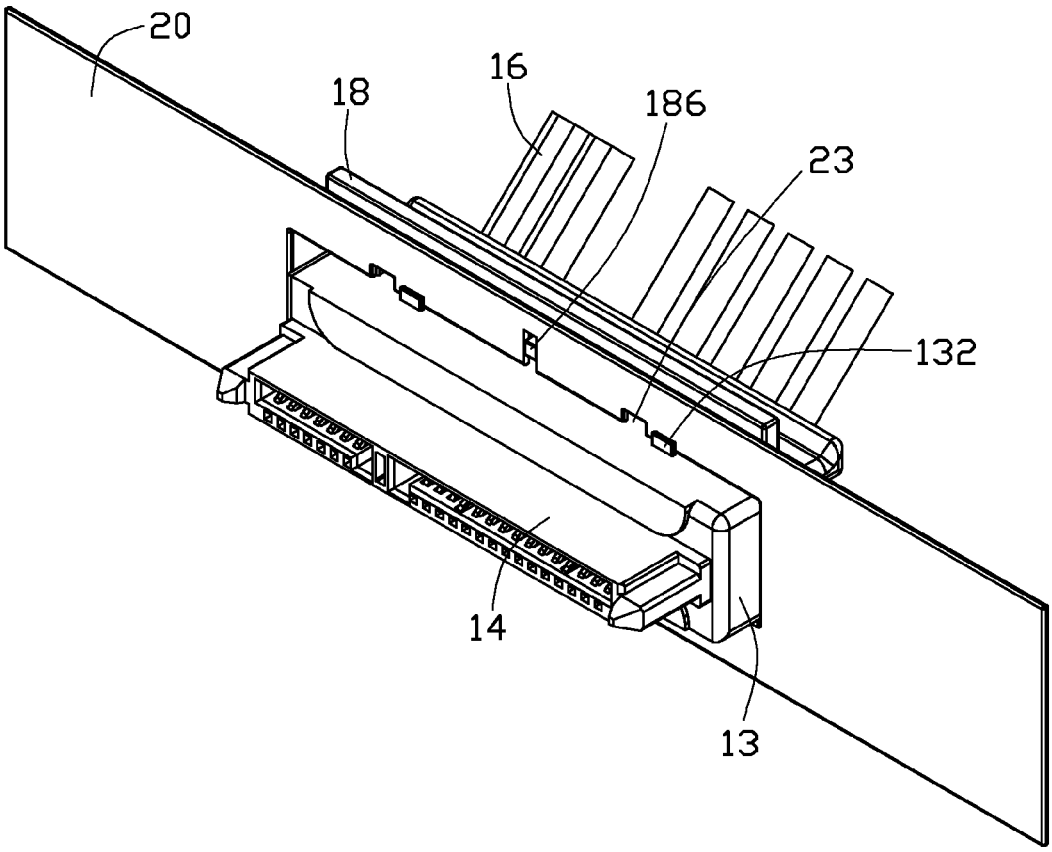
FIG. 3 is similar to FIG. 2, but showing the connector assembly of FIG. 2 fully assembled.

Referring to FIGS. 2 and 3, the connector 10 is assembled in the manner of a linear bayonet mounting, by being placed behind the fixing plate 20, and each of the four protrusions 132 is aligned with a notch of the four notches 23. The connector body 14 and a front part of the block 13 extend through the opening 21. The protrusions 132 come out through the notches 23. The pin 186 abuts against the rear surface of the fixing plate 20 to deform the latch 184 backward. After the protrusions 132 have passed the notches 23, the connector 10 is longitudinally slid along the opening 21 in one direction (the lock direction), moving the pin 186 towards the positioning hole 25. When the pin 186 meets the positioning hole 25, the latch 184 self-restores to push the pin 186 forwards and engage in the positioning hole 25. The heads of the protrusions 132, being no longer in line with the notches 23, allow the protrusions 132 to stagger with the corresponding notches 23 and blocked by a front surface of the fixing plate 20. The posts 180 and the connection piece 182 abut the rear surface of the fixing plate 20. Thereby, the connector 10 is fixed to the fixing plate 20.

To detach the connector 10 from the fixing plate 20, fingernail pressure pushes back the pin 186 to disengage from the positioning hole 25. The connector 10 may be slid in the direction (unlock direction) opposite to the lock direction, to allow the protrusions 132 to move towards the notches 23. When the protrusions 132 are once again aligned with the notches 23, the connector 10 can be pulled away from the fixing plate 20.

Even though numerous characteristics and advantages of the embodiments have been set forth in the foregoing description, together with details of the structure and the functions of the embodiments, the disclosure is illustrative only, and changes may be made in details, especially in the matters of shape, size, and arrangement of parts within the principles of the embodiments to the full extent indicated by the broad general meaning of the terms in which the appended claims are expressed.

What is claimed is:

1. A connector comprising:

a block;

a connector body formed on a front surface of the block;

a limiting member extending from a top of the block and comprising a deformable latch; and two protrusions respectively extending from the top and a bottom of the block;

wherein the limiting member comprises two posts extending from the top of the block and a connection piece connected between the posts; and wherein the latch extends down from the connection piece and then extends forward to form a pin.

2. The connector of claim 1, wherein the block and the limiting member are made of plastic.

3. A connector assembly comprising:

a connector comprising a block, a connector body formed on a front surface of the block, a limiting member extending from a top of the block, and two protrusions respectively extending from the top and a bottom of the block, the limiting member comprising a deformable latch; and a fixing plate defining an opening through which the connector body extends, two notches respectively communicating with top and bottom sides of the opening, and a positioning hole communicating with the opening;

wherein when the connector body is extended through the opening with the two protrusions respectively aligning with and passing through the two notches, the latch is deformed to abut against a rear surface of the fixing plate, then, when the connector body is slid along the opening to allow the protrusions to stagger with the corresponding notches and allow the latch to align with the positioning hole, the latch restores to engage in the positioning hole, the protrusions are blocked by a front surface of the fixing plate, the limiting member is blocked by the rear surface of the fixing plate.

4. The connector assembly of claim 3, wherein the limiting member comprises two posts extending from the top of the block and a connection piece connected between the posts.

5. The connector assembly of claim 4, wherein the latch extends down from the connection piece and extends forward to form a pin engaged in the positioning hole.

6. The connector assembly of claim 3, wherein the block and the limiting member are made of plastic.

* * * * *